US005647197A

United States Patent [19]

Imamura

[11] Patent Number: 5,647,197

[45] Date of Patent: Jul. 15, 1997

[54] FIBER SPINNING METHOD AND APPARATUS UTILIZING A TWISTING GUIDE

[75] Inventor: Yuji Imamura, Kyoto, Japan

[73] Assignee: Murata Kikai Kabushiki Kaisha, Kyoto, Japan

[21] Appl. No.: 567,327

[22] Filed: Dec. 5, 1995

[30] Foreign Application Priority Data

Feb. 10, 1995 [JP] Japan ..... 7-046257

[51] Int. Cl.[6] ..... D01H 5/00; D01H 5/28

[52] U.S. Cl. ..... 57/328; 57/315; 57/333; 57/350; 57/352

[58] Field of Search ..... 57/332, 328, 341, 57/342, 343, 344, 350, 333, 315, 5, 352

[56] References Cited

U.S. PATENT DOCUMENTS

| | | | |
|---|---|---|---|
| 5,263,310 | 11/1993 | Mori | 57/328 |
| 5,295,349 | 3/1994 | Okamoto | 57/328 |
| 5,419,110 | 5/1995 | Mikami et al. | 57/328 |
| 5,511,373 | 4/1996 | Banba | 57/328 |
| 5,528,895 | 6/1996 | Deno | 57/333 |

FOREIGN PATENT DOCUMENTS

| | | | |
|---|---|---|---|
| 4102239 | 7/1992 | Germany | 57/333 |
| 5-71021 | 3/1993 | Japan | 57/333 |

*Primary Examiner*—William Stryjewski

*Attorney, Agent, or Firm*—Armstrong, Westerman, Hattori, McLeland & Naughton

[57] ABSTRACT

A spinning apparatus having a nozzle (n1) that exerts the actions of a rotating air current on the fiber (f), a hollow spindle (s1) and a fiber introduction member (e2) positioned opposite the inlet end part (s1") of the hollow spindle with a fiber guide member (E) arranged with a fiber guiding surface (e9) twisted in the rotation direction of the air flow and the fiber introduction member (e2) projecting from the fiber guide member toward the hollow spindle. The end part of the guide member (E) may be formed into a flat or a curved shape whereby a spun yarn with improved fiber evenness and having higher strength, a round cross section, a better exterior and resembling blend yarn which differs from core yarn, can be spun. Furthermore, improvements in the spinning properties and success rate of yarn piecing can be realized.

13 Claims, 6 Drawing Sheets

FIBER SPINNING METHOD AND APPARATUS UTILIZING A TWISTING GUIDE

FIELD OF THE INVENTION

This invention is related to a spinning method and apparatus for producing spun yarn by using a rotating air current.

BACKGROUND OF THE INVENTION

Previously, a spinning method and apparatus has been known which produces spun yarn by imparting a twist in the fiber by a rotating air current, having a nozzle that exerts the action of a rotating air current on a fiber bundle leaving a draft apparatus, a hollow spindle, and a needle shaped guide member that positions the end of the needle opposite the end part of the yarn introduction side of the hollow spindle.

The aforementioned spinning method and apparatus of the prior art spins one type of core yarn in which comparatively short fibers are wound onto the periphery of comparatively long fibers which form the core, but the cohesiveness between the fibers forming the core and the fibers wound onto the periphery is insufficient. Consequently, the yarn is insufficiently strong and a stiff spun yarn is produced.

In the above mentioned spinning method and apparatus of the prior art, as the fibers are dispersed over a larger area by the rotating air current, the fiber gathering and converging is bad, the number of fibers parallel to each other forming the spun yarn is reduced and as a consequence, there are many irregularities. Moreover, a spun yarn with an inferior outward appearance is produced.

SUMMARY OF THE INVENTION

It is a primary object of the present invention to solve the above mentioned problems with a spinning method and apparatus that produces spun yarn by the use of a previously known rotating air current.

In order to achieve the above mentioned object, in the spinning method of the present invention, the fiber bundle being transported from the front roller to the twist application area by a rotating air current is conveyed while being twisted in a fixed direction and is also transported to the said twist application area while being maintained in a converged state.

And also, in order to achieve the above mentioned object, the spinning apparatus of the present invention has a nozzle that exerts the actions of a rotating air current on the fiber, a hollow spindle and a fiber introduction member utilizing a fiber converging unit positioned opposite the end part of the fiber introduction side of the hollow spindle. And the said fiber converging unit has a fiber guiding surface which is twisted in the direction of the aforementioned rotating air current, and also the end part, which is connected to the fiber guiding surface of the aforementioned fiber converging unit is formed with a discontinuous surface.

DERAILED DESCRIPTION OF THE PREFERRED EMBODIMENT

Figure 1:
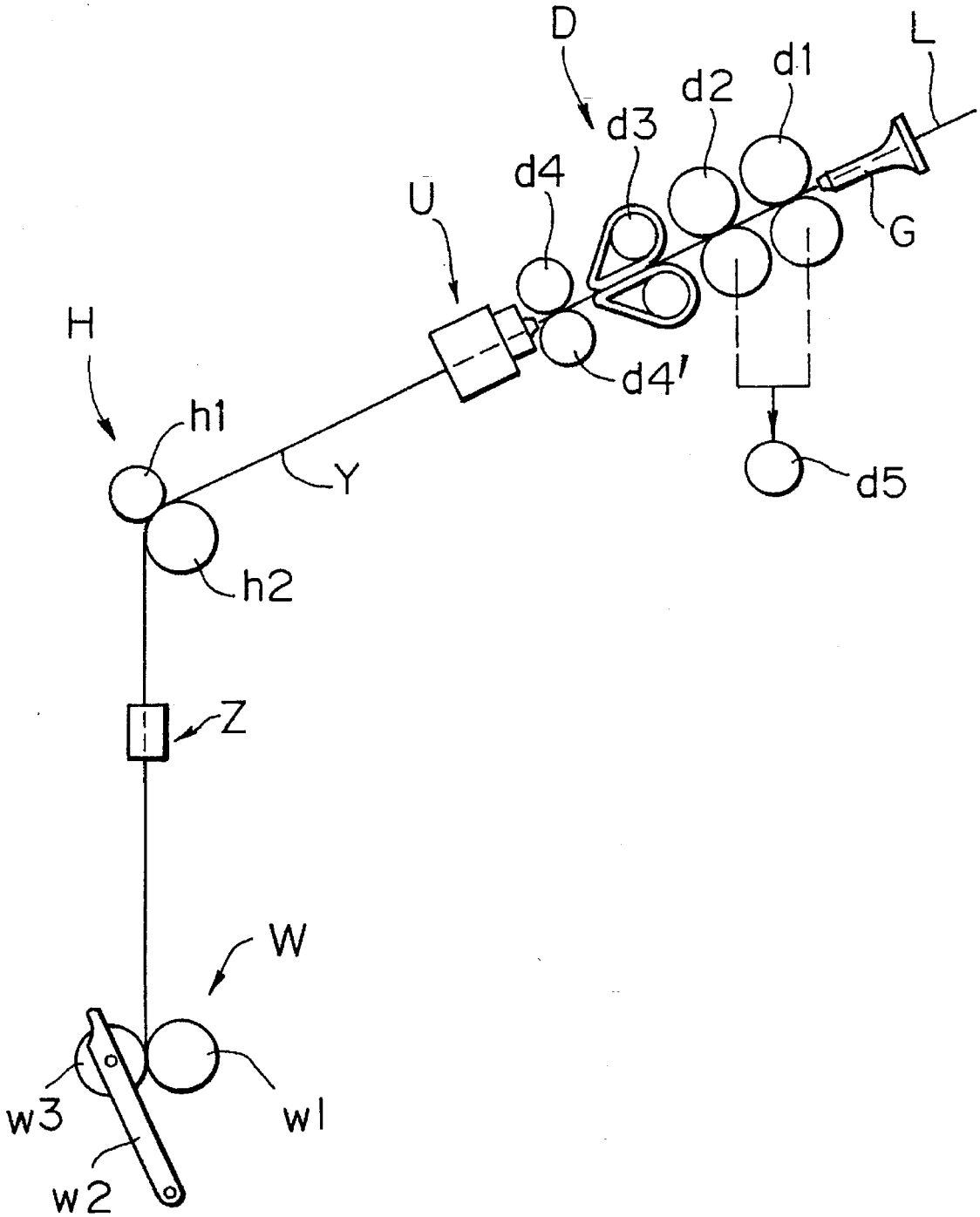
FIG. 1 is a simplified side elevation view of the spinning apparatus applicable to the present invention.

In the drawings and the specification, there has been set forth a preferred embodiment of the invention, and although specific terms are employed, they are used in a generic and descriptive sense only and not for the purposes of limitation.

Firstly, using FIG. 1, the entire construction of the spinning apparatus of the present invention will be explained.

(L) is the fiber sliver supplied to the draft apparatus (D) via the sliver guide (G). The draft apparatus (D) comprises back rollers (d1), third rollers (d2), second rollers (d3) having an apron, and front rollers (d4). On the draft apparatus (D), the drafted sliver (L) is supplied to the spinning unit (U) comprising the separable nozzle and spindle member later described and after being formed as a spun yarn (Y) by the spinning unit (U), the spun yarn (Y) passes the spun yarn delivery apparatus (H) comprising the nip roller (h1) and delivery roller (h2), and also the slub catcher (Z), and is then wound onto the package (w3) which is supported by the cradle arm (w2) and which is driven by the friction roller (w1) of the winding part (W). Furthermore, (d4') is the bottom roller of the front roller (d4). (d5) is the clutch apparatus, like a magnetic clutch, for driving or stopping the back roller (d1) or third roller (d2).

Next, using FIG. 2, which is a vertical section view in the running direction of the spun yarn (Y) of the spinning unit (U) shown in FIG. 1, the spinning unit (U) comprising the separable nozzle member (N) and the spindle member (S) which will be explained.

(n1) is a nozzle. The flange part (n1'), (n1") of nozzle (n1) is sandwiched by the nozzle housing (n2) and the nozzle support plate (n4) which is attached to the inside concave part (n3') of the nozzle outer frame (n3), and due to the nozzle housing (n2) and the nozzle support plate (n4) being coupled together by bolt (n5), the nozzle (n1) is arranged in the space between the nozzle housing (n2) and the nozzle support plate (n4). (n6) is an air chamber arranged at predetermined spacings formed from the nozzle housing (n2) and the two flange parts (n1'), (n1") of the nozzle (n1). Air blowing holes (n8) are formed facing in a direction tangential to the inside surface of the nozzle (n1) so the air chambers (n6) are connected to the roughly round column shape hollow chamber (n7) of the nozzle (n1). More than one air blowing hole (n8), for example 4, are arranged in the circumferential direction of the nozzle (n1). The nozzle member (N) is mainly comprised of the abovementioned nozzle (n1), nozzle housing (n2), nozzle outer frame (n3) and the nozzle support plate (n4).

(s1) is a hollow spindle having a hollow passage (s1') and said spindle (s1) is attached to the spindle support frame (s2). (s3) is a moving frame onto which is attached the aforementioned nozzle outer frame (n3) having a guide hole (s4) through which passes guide rod (R). Hole (s3'), which receives the spun yarn (Y) ejection side end part of the hollow spindle (s1) and is attached to the spindle support frame (s2) and one part of the spindle support frame (s2), is arranged in approximately the center of the moving frame (s3).

Furthermore, in the moving frame (s3), a plurality of holes (s5), for example three, are arranged at appropriate spacings running in the longitudinal direction of the hollow spindle (s1) and a flange part (s6) having a bolt insertion hole (s6') smaller in diameter than the inner diameter of the holes (s5) projects out from the middle part of the inside wall of hole (s5). (s7) is a projected part that is arranged on the spindle support frame (s2) of which the end part is inserted into the hole (s5).

(s8) is a bolt screwed into the projecting part (s7) which is arranged on the spindle support frame (s2). The head (s8') of bolt (s8) is in contact with, or close to, the flange part (s6) projecting in the hole (s5) and the screw trunk part (s8") is inserted into the bolt insertion hole (s6'). (s9) is a compression coil spring arranged between the flange part (s6) and the end surface of the projecting part (s7) on the spindle support frame (s2). The spindle support frame (s2) is connected to the moving frame (s3) via the bolt (s8), and the spindle support frame (s2) and moving frame (s3) are forced into each other so that they are seperated in opposite directions by the compression coil spring (s9). Further, the head (s8') of bolt (s8) is formed so that it catches on the flange part (s6) and does not pass through the bolt insertion hole (s6').

(s2') is a generally circular connecting part arranged on the nozzle (n1) side of the spindle support frame (s2). A curved corner is formed on the shoulder part (s2") of the connecting part (s2'). (s10) is the horn-shaped guide pipe for guiding the parent yarn which is inserted through the hollow passage (s1') of the hollow spindle (s1) that is attached to the end part of the spun yarn (Y) ejection side of the hollow spindle (s1) when yarn piecing is carried out.

The spindle member (S) is mainly comprised of the aforementioned hollow spindle (s1), the spindle support frame (s2), the moving frame (s3), the bolt (s8), the compression coil spring (s9) and the guide pipe (s10).

(s11) is the pin projecting from the side wall of the moving frame (s3). The pin (s11) is connected to the concave part (v1) arranged on the end of the rotating lever (V) which can be rotated to the left and right as seen from FIG. 2 about a predetermined support point by a piston rod (not shown in the drawing). Consequently, as in FIG. 2, due to the movement of the rotating lever (V) in a leftwards direction, the spindle member (S) is made to move to the left along the guide rod (R) via the pin (s11) connected to the concave part (v1) of the rotating lever (V) and the spindle member (S) is formed so as to be separable from the nozzle member (N).

Figure 2:
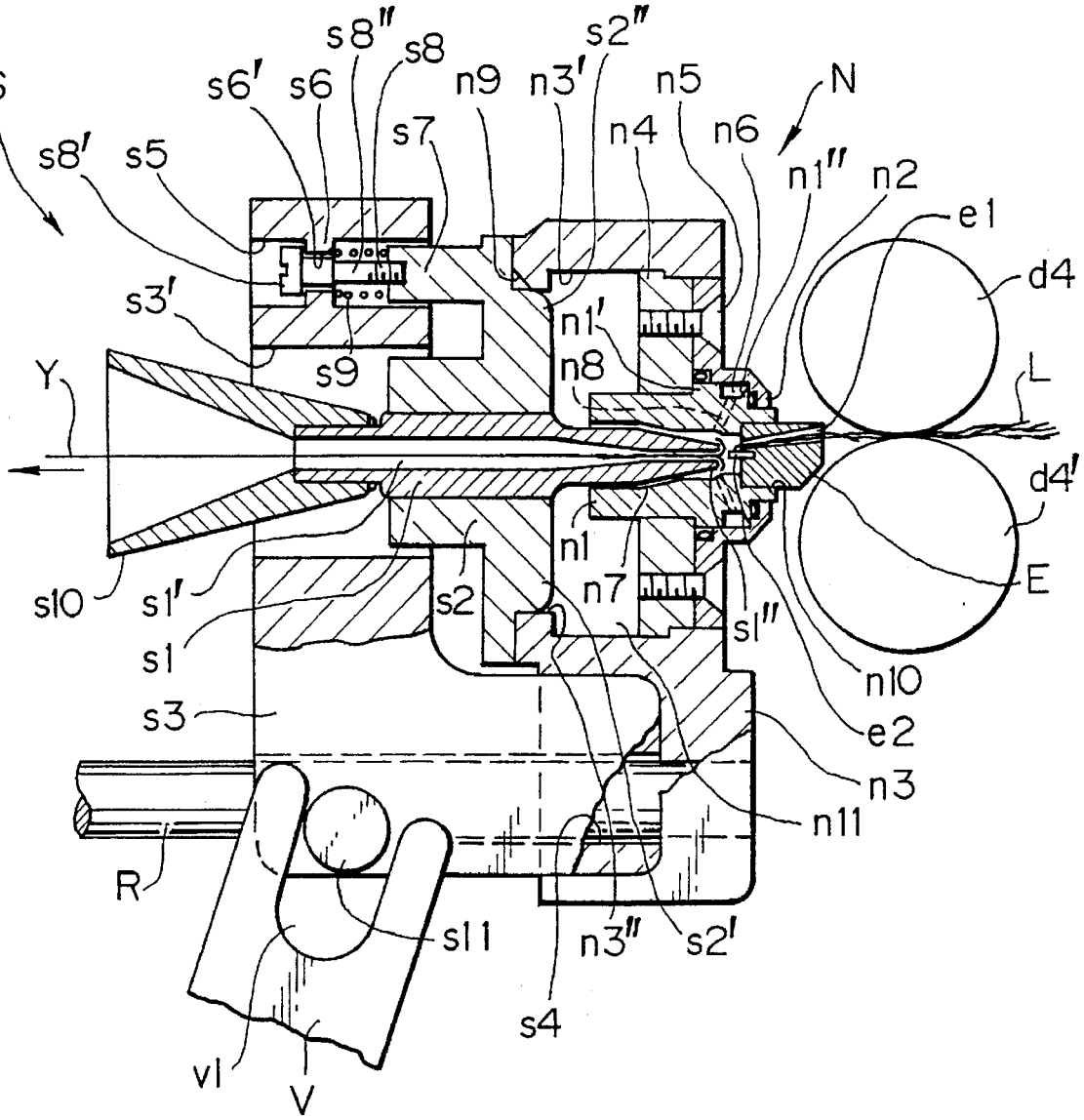
FIG. 2 is a vertical sectional view of one example of a spinning unit according to the invention.

Also, in reverse, due to the movement of the rotating lever (V) in a rightwards direction, the spindle member (S) moves to the right in the same way and, due to the connection between the connecting part (s2') of the spindle member (S) and the open part (n3") of the nozzle outer frame (n3) of the nozzle member (N), the spindle member (S) and nozzle member (N) are constructed so as to be joinable, as shown in FIG. 2.

Furthermore, for this connection, a curved corner is formed on the shoulder part (s2") of the connecting part (s2') of the spindle support frame (s2). Also, as a slope (n9) is formed on the side edge of the open part (n3") of the nozzle outer frame (n3), while the shoulder part (s2") of the connecting part (s2') of the spindle support frame (s2) is being guided to the slope (n9) of the nozzle outer frame (n3), the connecting part (s2') of the spindle support frame (s2) is connected to the open part (n3") of the nozzle outer frame (n3). Thus the nozzle member (N) can be coupled to the spindle member (S) so that the center of the hollow spindle (s1) of the spindle member (S) is aligned with the center of the nozzle (n1) of the nozzle member (N).

Furthermore, in order to connect the connecting part (s2') of the spindle support frame (s2) to the open part (n3") of the nozzle outer support (n3), the rotating lever (V) is rotated in the right and the spindle member (S) moves to the right as seen from FIG. 2. However, after the connecting part (s2') of the spindle support frame (s2) is connected to the open part (n3") of the nozzle outer support (n3), when the rotating lever (V) rotates right by only a further predetermined amount, the spindle support frame (s2) contacts with the nozzle outer frame (n3). Therefore, there is no more movement of the support frame s2 to the right but the moving frame (s3) moves further to the right thus compressing the compression coil spring (s9) which is positioned between the flange (s6) and the projecting part (s7) of the spindle support frame (s2). In this way, in the state in which the moving frame (s3) compresses the compression coil spring (s9), due to the stopping, the spindle support frame (s2) normally assumes contact with the nozzle outer frame (n3) by a predetermined contact pressure. Therefore, a gap on the contact faces can be formed between the spindle support frame (s2) and the nozzle outer frame (n3), and the problem of air leaking from this gap etc can be prevented.

(E) is the fiber converging unit having a fiber introduction hole (e1) inserted in the concave part (n10) which is arranged on the front roller (d4) side of the nozzle (n1). An approximately cylindrical guide member (e2) is attached to the hollow spindle (s1) side of the fiber converging unit member (E) so as to be opposite the entrance part of the hollow passage (s1') of the hollow spindle (s1).

(n11) is an air chamber arranged in the nozzle member (N). Air chamber (n11) is linked to the suction duct via a hole (not shown in the drawing) arranged on the nozzle outer frame (n3). The suction duet is connected to the air suction apparatus (not shown in the drawing) and is constructed in such a way that the air chamber (n11) is maintained in a state of slight negative pressure. Due to the maintenance of the air chamber (n11) in a state of slight negative pressure, floating fibers and the like that are generated in the hollow chamber (n7) during spinning are removed via the gap between the inner surface of the nozzle (n1) and the outer surface of the hollow spindle (s1).

Next, the production process of spun yarn (Y) by the spinning unit consisting of the aforementioned nozzle member (N) and spindle member (S) will be explained.

The drafted sliver (L) which has been transported from the front roller (d4) of the draft apparatus (D) is sucked into the hollow chamber (n7) inside the nozzle (n1) by the suction air current in the vicinity of the fiber introduction hole (e1) of the fiber introduction member (E) which is generated by the action the blown air from the air blowing holes (n8) bored in the nozzle (n1).

The fiber (f) comprising the sliver (L) which had been sucked into the hollow chamber (n7) is sent following the periphery of the roughly cylindrical guide member (e2). In the vicinity of the end part (s1') of the hollow spindle (s1), the fiber (f) undergoes the action of the rotating air current which has been blown from the air blowing holes (n8) and is rotating at high speed around the circumference of the hollow spindle (s1) and while seperating from the sliver (L), is twisted in the direction of the rotating air current. Also, one part of the false twist, which has been imparted by the rotating air current, tries to travel in the direction of the front roller (d4) but, as this travel is prevented by the roughly cylindrical guide member (e2), there is no entangling by the false twist of the sliver (L) which has been sent from the front roller (d4). The above mentioned twisted fiber (f) is continuously generated into spun yarn (Y), runs through the hollow passage (s1') of the hollow spindle (s1) and is sent in the direction of the winding part (W).

Next, using FIG. 3 which is an enlarged exploded perspective view of the fiber converging unit (E) having the above mentioned fiber introduction hole (e1), the fiber converging unit (E) will be explained.

Figure 3:
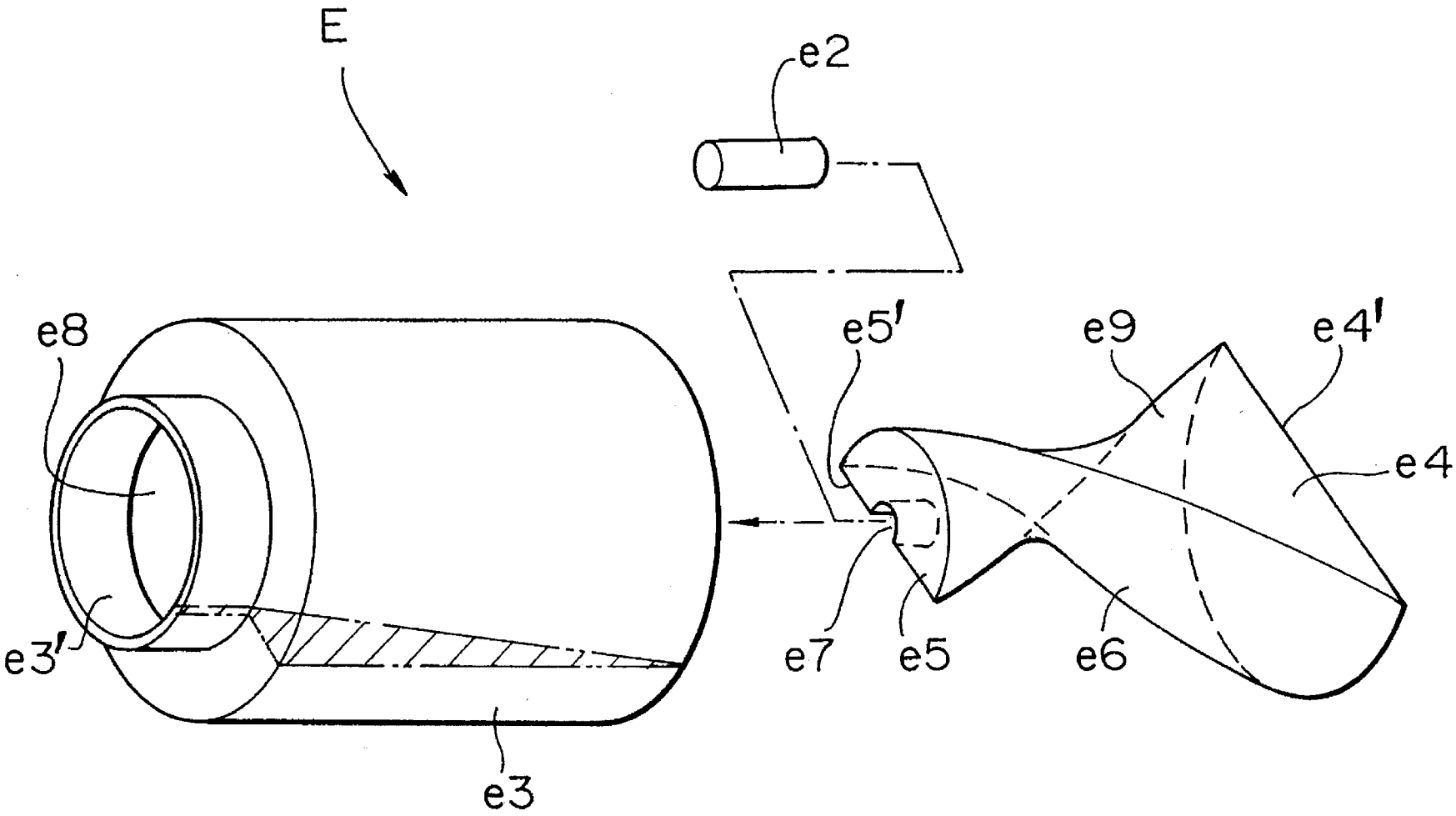
FIG. 3 is an enlarged exploded perspective view of a fiber converging unit.

As shown in FIGS. 2 and 3, the fiber converging unit (E) is comprised of an approximately cylindrical outer frame member (e3), the aforementioned guide member (e2) and a fiber guiding member (e6). The outer frame member (e3) is attached to the concave part (n10) arranged on the front roller (d4) side of the nozzle (n1). The fiber guiding member (e6) has the shape of a truncated cone cut approximately in half along it's longitudinal central axis and twisted from the smaller diameter part (e5) to the larger diameter part (e4). A groove part (e7) to which is attached the above mentioned roughly cylindrical guide member (e2) is bored into the fiber guiding member (e6). The inner hole (e8) of the aforementioned outer frame member (e3) is formed as a hole in a reverse truncated cone as made clear from the section of the peripheral wall including the central line of the outer frame part shown as hatching in FIG. 3. Furthermore, (e3') is a cylindrical brim part having a diameter smaller than the outer diameter of the outer frame member (e3) and extending from the fiber ejection side of the outer frame member (e3).

As shown in FIG. 3, the guide member (e2) is attached to the groove part (e7) of the fiber guiding member (e6) so that a predetermined length protrudes and the fiber guiding member (e6), to which is attached the guide member (e2), is inserted into the outer frame member (e3) from the smaller diameter part (e5). Consequently, roughly half of the inner hole (e8) of the outer frame part (e3) is occupied by the fiber guiding member (e6) and the fiber introduction hole (e1) is formed from the raining half.

Next, using the same FIG. 3, the shape of the fiber guiding surface (e9) of the fiber guiding member (e6) which introduces the fiber (f) along rotating suction air current will be explained.

The fiber guiding surface (e9) of the fiber guiding member (e6) having a shape of an approximate truncated cone cut down the central axis roughly in half is so formed as to be a plane twisted from the large diameter side (e4) of the fiber guiding member (e6) to the small diameter side (e5) and along which flows the rotating suction air current of the vicinity of the fiber introduction hole (e1) of the fiber converging unit (E) generated by the action of the blown air from the air blowing holes (n8). The twist angle of the fiber guiding surface (e9) (when the small diameter side (e5) is viewed from the large diameter side (e4) of the fiber guiding member (e6), the angle of the section line (e5') of the small diameter side (e5) compared to the section line (e4') of the large diameter side (e4), which is used as a base, is called the twist angle of the fiber guiding surface (e9)) will differ depending on the type of fibers that comprise the sliver (L), the fiber length, desired number of twists in the spun yarn (Y), stiffness etc, but an angle of over 30° is preferential, between 30° and 210° is better, and an ideal angle is between 45° and 210°. Furthermore, due to the rotating direction of the rotating suction air current, the twist direction of the fiber guiding surface (e9) may also be opposite to the twist direction as shown in FIG. 3.

Due to the fact that the twist angle of the fiber guiding surface (e9) is a predetermined angle, the fiber (f) which is transported along the fiber guiding surface (e9) of the fiber guiding member (e6) by the aforementioned rotating suction air current has increased convergence, evenness with increased strength and a yarn (Y) with a better exterior finish can be spun. If the twist angle of the fiber guiding surface (e9) is less than 30°, as the fiber guiding surface (e9) is nearly flat, the fiber (f) is dispersed over a wide area causing poor convergence and as a consequence, the evenness of the fiber (f) is disrupted and the strength of the spun yarn (Y) and exterior finish are diminished. By increasing the twist angle of the fiber guiding surface (e9), the convergence is improved and a even yarn (Y) with increased strength can be spun. However, depending on the properties of the fiber (f), such as the length and stiffness, if the twist angle of the fiber guiding surface (e9) is increased beyond what is necessary, the fiber (f) is no longer transported smoothly along the fiber guiding surface (e9) and effective spinning of the yarn (Y) becomes difficult. Therefore, depending on the type of fiber (f), the humidity etc, the twist angle of the fiber guiding surface (e9) is theoretically or experimentally set.

The approximately cylindrical guide member (e2) is attached to approximately the center of the small diameter side (e5) of the fiber guiding member (e6) and it is preferable for the end of the guide member (e2) to be positioned so that it is seperated from the end part (s1") of the hollow spindle (s1) by a predetermined distance. Also, the outer diameter of the approximately cylindrical guide member (e2) may be smaller, larger or the same size as the inner diameter of the hollow passage (s1') on the end part (s1") of the hollow spindle (s1). Of course, the guide member (e2) can also be formed together with the fiber guiding member (e6) as a single structure without being attached to the groove (e7) of the fiber guiding member (e6).

FIG. 4 shows the various shapes of the fiber guiding member (e6) and the guide members (e2). As described above, FIG. 4A is the component of the guide member (e2) formed together with the fiber guiding member (e6) as a single structure.

Figure 4A:
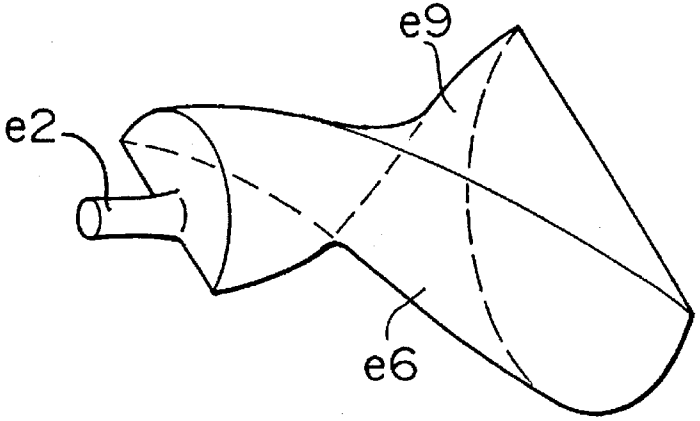
FIGS. 4A, 4B, 4C and 4D are perspective views showing other examples of the fiber guiding members and guide members.
Figure 4B:
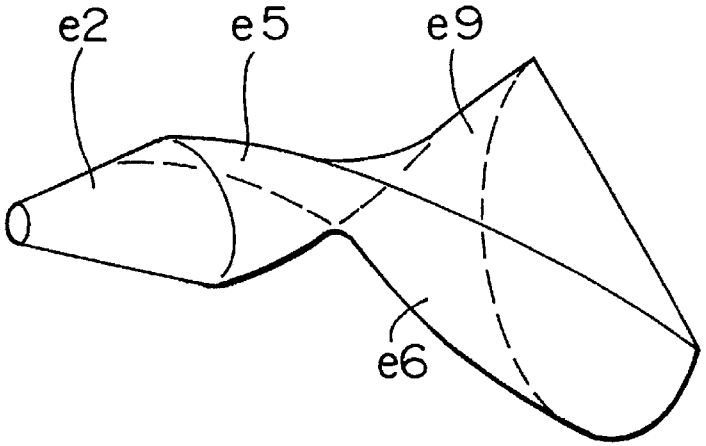

FIG. 4B is a guide member (e2) formed as a truncated cone extending as a tapered shape from the small diameter side (e5) of the fiber guiding member (e6).

Figure 4C:
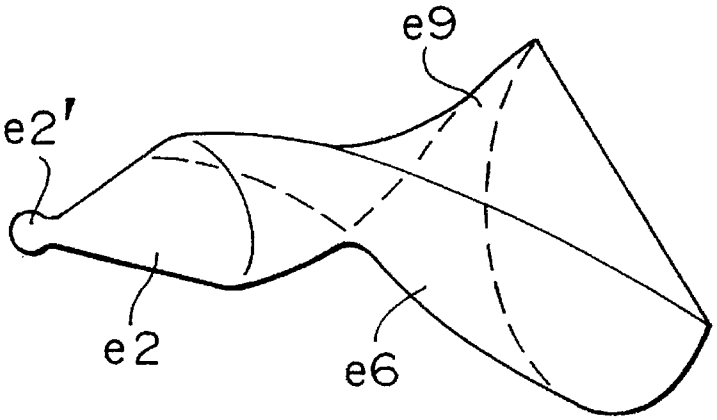

The guide member (e2) shown in FIG. 4C is a component with a ball shape (e2') swollen on the end of the truncated cone shape guide member (e2) shown in FIG. 4B.

Figure 4D:
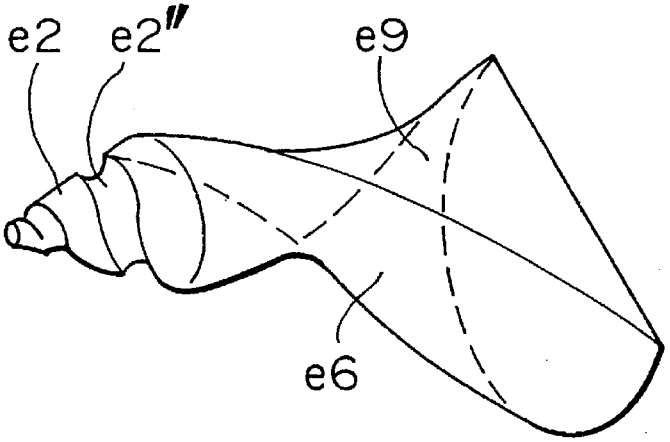

The guide member (e2) shown in FIG. 4D comprises a screw shaped groove (e2") in the circumference face of the truncated cone shape guide member (e2) shown in FIG. 4B.

In any of the above cases, the guide member (e2) and the fiber guiding member (e6) can be comprised of a single structure. As shown in FIG. 4, the composition of the end of the guide member (e2) is important whether it is flat or curved.

Figure 5:
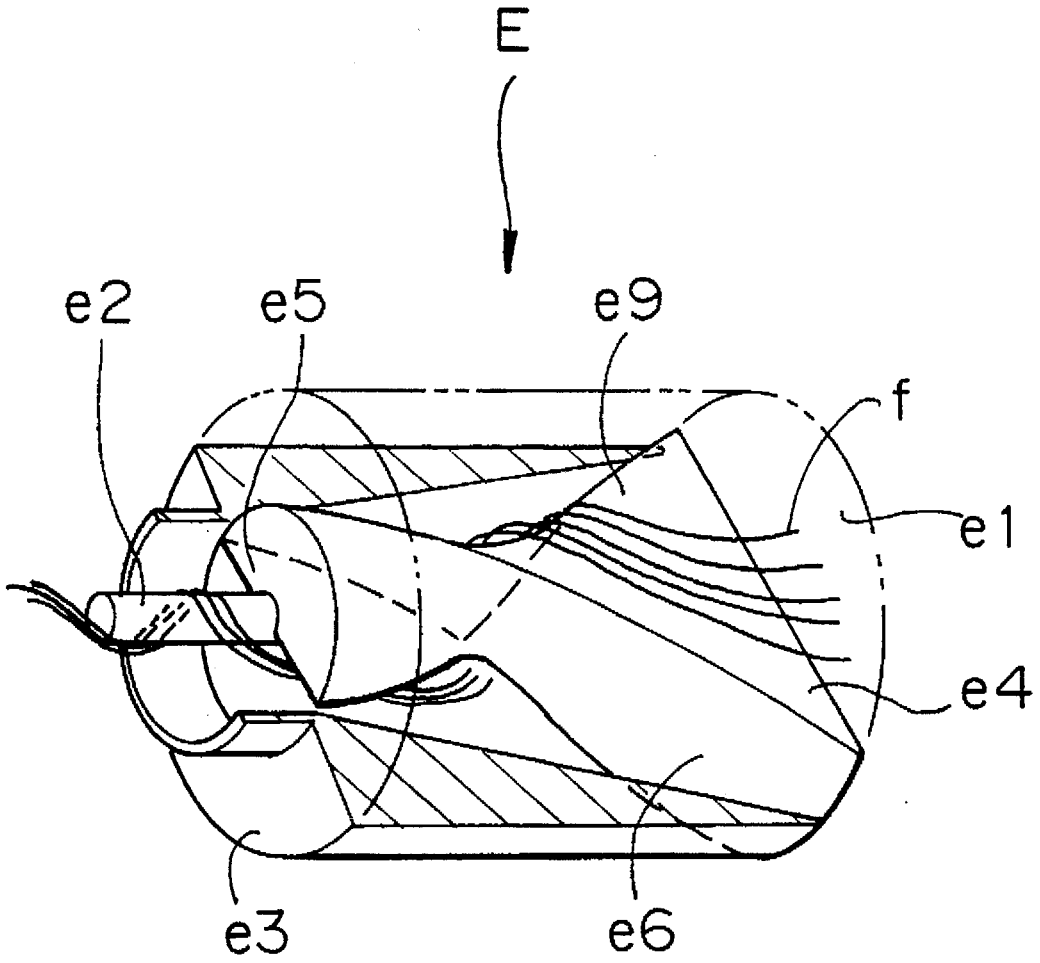
FIG. 5 is an assembled perspective view of the fiber introduction member which includes a partial cross section.

Next, using FIG. 5, which is an assembled perspective view of the fiber converging unit (E) including a partial cross section, the movement of the fiber (f) which is inserted from the fiber introduction hole (e1) of the fiber converging unit (E) will be explained.

The rotating suction air current in the vicinity of the fiber introduction hole (e1) of the fiber converging unit (E) generated by the actions of the rotating air current formed from compressed air blown from the air blowing holes (n8) flows toward the small diameter side (e5) from the large diameter side (e4) of the fiber guiding member (e6) along the fiber guiding surface (e9) which twists toward the small diameter side (e5) from the large diameter side (e4) of the fiber guiding member (e6) in the same direction as the rotating suction air current. Accordingly, the fiber (f) transported by the rotating suction current steadily converges from a slightly spread-out state at the large diameter side (e4) of the fiber guiding member (e6) while being transported along the twisted fiber guiding surface (e9). As well as being converged, the fiber (f) proceeds by winding in the twisted state in one direction around the roughly cylindrical guide member (e2) positioned approximately in the center of the small diameter side (e5) and afterwards, passes through the hollow chamber (n7) and while having a twist imparted, the spun yarn (Y) is continuously produced and then sent in the direction of the winding part (W) through the hollow passage (s1') of the hollow spindle (s1).

As mentioned above, the fiber (f) that is transported on the rotating suction current along the twisted fiber guiding surface (e9) is quickly and reliably converged and can be smoothly wound around the guide member (e2) in the state in which it is twisted by the fiber guiding surface (e9). Also, as the guide member (e2) is approximately cylindrical, even if the converged fiber (f) pulls away from the end of the guide member (e2), the spiralled fiber (f) is maintained in a converged state between the end of the guide member (e2) and the end part (s1") of the hollow spindle (s1). Accordingly, in this space, many fibers (f) which have seperated from the slaver (L) are twisted onto the converged fiber (f) among the spun yarn (Y) formation process.

In the case in which the end part of the guide member (e2) is not formed to a flat or curved shape consisting of a discontinuous surface as in the present invention and where the end of the guide member (e2) comprises a pointed needle shape consisting of a continuous surface as in the prior art, the converged fiber (f) which is wound on the guide member (e2) moves gradually from a spiral shape to a straight shape and in the state in which it pulls off from the end of the guide member (e2), as it is approximately straight, the converged fiber (f) that exists between the end of the guide member (e2) and the end part (s1") of the hollow spindle (s1) is shorter compared to the present invention's case. Moreover, as it is not in a twisted state, there is little twisting in of the fibers (f) and there is insufficient cohesion. Consequently, the strength of the produced spun yarn (Y) is insufficient, the exterior finish is poor and the yarn cross section is not round but a flat eliptical shape.

On the spinning apparatus of the present invention, it is preferable for the end of the guide member (e2) to be apart from the end part (s1") of the hollow spindle (s1) by a predetermined distance. Due to there being a predetermined space arranged between the end of the guide member (e2) and the end part (s1") of the hollow spindle (s1), trash (various objects, such as trash contained in the sliver) flies out from this space due to centrifugal force. Consequently, trash is prevented from being caught between the end of the guide member (e2) and the end part (s1") of the hollow spindle (s1) and breakage of the yarn can be prevented. The degree of spacing between the end of the guide member (e2) and the end part (s1") of the hollow spindle (s1) is set theoretically or experimentally depending on the properties of the fiber (f). Furthermore, depending on the properties and type of fiber (f) comprising the sliver (L), the end of the guide member (e2) can also be so arranged as to slightly enter the end part (s1") of the hollow spindle (s1).

A fiber sliver (L) used in the above mentioned spinning apparatus of the present invention is comprised of a mixture of long fibers (f') having a fiber length longer than the distance from the nip point (X) of the front roller (d4) and of the bottom roller (d4') to the end part (s1") of the hollow spindle (s1), and short fibers (f") having a fiber length shorter than the distance from the nip point (X) of the front roller (d4) and of the bottom roller (d4') to the end part (s1") of the hollow spindle (s1).

Figure 6:
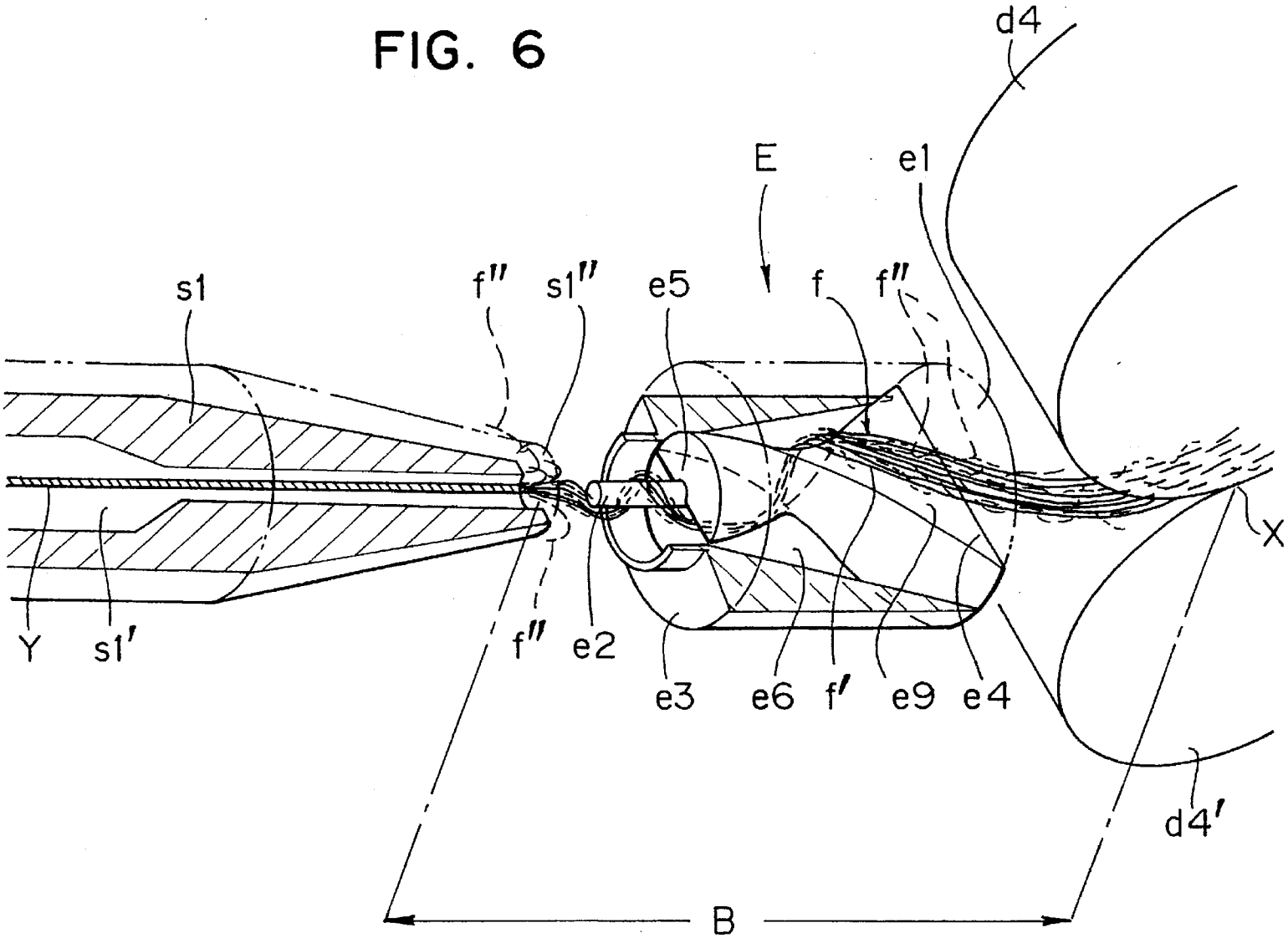
FIG. 6 is an enlarged perspective view, partly in section of the fiber introduction member etc.

Using FIG. 6 which is a partially expanded perspective view of the hollow spindle (s1), fiber converging unit (E), etc, the movements of the fiber (f) when a combined fiber (f) of long fibers (f') having a fiber length longer than the distance (B) from the nip point (X) of the front roller (d4) and of the bottom roller (d4') to the end part (s1"), of the hollow spindle (s1) and short fibers (f") having a fiber length shorter than that distance (B), is used on the spinning apparatus arranged on which is the fiber converging unit (E) having a face twisted toward the small diameter side (e5) from the large diameter side (e4), as described above, will be explained.

When the front end of the long fibers (f') having a fiber length longer than the distance B from the nip point (X) to the end part (s1") of the hollow spindle (s1) (in FIG. 6, imitatively shown by the solid lines) are positioned in the vicinity of the end part (s1") of the hollow spindle (s1) or inserted in the hollow passage (s1') of the hollow spindle (s1), the other end is gripped by the nip point (X) of between the front roller (d4) and the bottom roller (d4'). Furthermore, the end of the long fiber (f') inserted in the hollow passage (s1') of the hollow spindle (s1) or in the vicinity of the end part (s1") of the hollow spindle (s1) is spread out by the rotating air current at the end part (s1") of the hollow spindle (s1).

Conversely, the short fibers (f") having a fiber length shorter than the distance (B) from the nip point (X) to the end part (s1") of the hollow spindle (s1) (in FIG. 6, imitatively shown by the dotted lines) ride on the rotating current which faces the periphery of the guide member (e2) along the fiber guiding surface (e9) which is twisted towards the small diameter side (e5) from the large diameter side (e4) of the fiber guiding member (e6), as described above, and are transported to the end part (s1") of the hollow spindle (s1) along with the long fibers (f') which face the periphery of the guide member (e2) along same fiber guiding surface (e9).

In this transportation process, the short fibers (f") are caught in the spread out long fibers (f') and wound onto the periphery of the long fibers (f'). Furthermore, the long fibers (f') twist in the short fibers (f") which are distributed approximately evenly around the periphery of the end part (s1") of the hollow spindle (s1) thus producing the spun yarn (Y). Accordingly, this kind of production of spun yarn (Y) has a construction in which the short fibers (f") are caught between the long fibers (f') and also in which the short fibers (f") are wound around the periphery of the long fibers (f'). Moreover, due to the rotating air current which rotates in one direction around the guide member (e2), the winding direction of the short fibers (f"), which are wound onto the long fibers (f'), is approximately constant.

On the spinning apparatus of the present invention, the converged fiber (f) is smoothly wound onto the periphery of the guide member (e2) in a state in which it has been twisted by the fiber guiding surface (e9) and, as the end part of the guide member (e2) is formed to a flat shape or curved shape, even if the converged fiber (f) pulls away from the end of the guide member (e2), the converged condition of the spiral shaped fiber (f) is maintained between the end part of the guide member (e2) and the end part (s1") of the hollow spindle (s1). Therefore, a higher proportion of short fibers (f") are reliably caught in the long fibers (f') and are twisted in more strongly. Accordingly, a spun yarn (Y) with higher strength, a round cross section and a better exterior can be spun.

As the present invention is constructed as explained above, it has the following effectiveness.

Due to the present invention, a spun yarn (Y) with improved fiber evenness and having higher strength, a round cross section, a better exterior and resembling blend yarn which differs from core yarn, can be spun. Furthermore, an improvement in the spinning properties and success rate of yarn piecing can be realised.

What is claimed is:

1. A method of spinning fibers into yarn by the action of a rotating air current in a spinning unit having a fiber converging unit, comprising the steps of:

establishing a rotating air current in said spinning unit, conducting fibers to be spun to said fiber converging unit by an air flow induced by rotating air current, within said fiber converging unit, first, directing said fibers along a convergent spiralling path to form a fiber construct having a twisted configuration, and, thereafter, drawing said converged and twisted fiber construct across a surface in a divergent spiralling path to impart a tensile stress therein before discharging said fiber construct from said fiber converging unit.

2. The spinning method according to claim 1 including the step of winding the fiber construct emerging from said spinning unit about an axially disposed guide member.

3. A spinning apparatus comprising:

a hollow spindle having an inlet end and an outlet end, a nozzle enclosing said inlet end of said spindle, a fiber converging unit defining an inlet to said nozzle and containing an inlet for receiving fibers to be spun, an outlet for discharging fibers in an at least partially spun state, and a guide path for conducting fibers admitted to said fiber converging unit in a spiral between said inlet for receiving fibers and said outlet for discharging fibers, said guide path being formed with convergent and divergent sections whereby said fibers converge and are twisted while moving in a convergent spiral and tensioned while moving in a divergent spiral, and means for inducing movement of said fibers through said fiber converging unit.

4. The spinning apparatus according to claim 3 in which said means for inducing movement includes means for directing air tangentially through said nozzle for generating rotating air currents through said spinning unit.

5. The spinning apparatus according to claim 4 in which said fiber converging unit comprises:

an outer frame containing an axially tapered conical wall;

a fiber guiding member concentrically disposed within said outer frame, said fiber guiding member being formed by a body containing opposed frusto-conically formed portions connected by a neck portion and a spirally directed fiber guiding surface cut into the exterior of said body and cooperating with the wall of said outer frame to form a continuous passage having a convergent first portion and a divergent second portion.

6. The spinning apparatus according to claim 5 including an axially disposed guide member for directing a spun fiber construct from an outlet of said passage to said inlet end of said spindle.

7. The spinning apparatus according to claim 6 in which said guide member is a cylindrical member attached to an end of said fiber guiding member.

8. The spinning apparatus according to claim 6 in which said guide member is a convergent conical body attached to an end of said fiber guiding member.

9. The spinning apparatus according to claim 8 in which said conical body of said guide member contains a spiral groove.

10. The spinning apparatus according to claim 8 in which a free end of said guide member is flat.

11. The spinning apparatus according to claim 8 in which a free end of said guide member is bulbous.

12. The spinning apparatus according to claim 6 in which a free end of said guide member is axially spaced from said inlet end of said spindle.

13. The spinning apparatus according to claim 5 in which said fiber surface contains a twist angle greater than thirty degrees.

* * * * *